US011761454B2

(12) United States Patent
Yao

(10) Patent No.: US 11,761,454 B2
(45) Date of Patent: Sep. 19, 2023

(54) CEILING FAN BLADE FASTENING STRUCTURE

(71) Applicant: Chao Chin Yao, Taichung (TW)

(72) Inventor: Chao Chin Yao, Taichung (TW)

( * ) Notice: Subject to any disclaimer, the term of this patent is extended or adjusted under 35 U.S.C. 154(b) by 0 days.

(21) Appl. No.: 17/649,188

(22) Filed: Jan. 27, 2022

(65) Prior Publication Data

US 2023/0235749 A1 Jul. 27, 2023

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01); *F05D 2260/36* (2013.01)

(58) Field of Classification Search
CPC ..... F04D 25/088; F04D 29/34; F05D 2260/36
See application file for complete search history.

(56) References Cited

U.S. PATENT DOCUMENTS 10,578,121 B2 * 3/2020 Tang ..... F04D 25/088

FOREIGN PATENT DOCUMENTS

AU 2018247367 A1 * 4/2020

* cited by examiner

*Primary Examiner* — Courtney D Heinle
*Assistant Examiner* — John S Hunter, Jr.
(74) *Attorney, Agent, or Firm* — Muncy, Geissler, Olds & Lowe, P.C.

(57) ABSTRACT

A ceiling fan blade fastening structure includes a base and a fan blade. The base is fixed to a rotor of a motor of a ceiling fan. The base has a bottom wall and a peripheral wall. The peripheral wall has a slot. The bottom wall is provided with a guide rail portion adjacent to the slot. The bottom wall is provided with a bracket and a positioning block behind the guide rail portion. The fan blade has a tongue portion to be inserted into the slot and pressed against the positioning block, so as to position the fan blade. The tongue portion is provided with a stop block to be against the rear of the bracket, so that the fan blade is unable to be disengaged from the slot.

11 Claims, 14 Drawing Sheets

CEILING FAN BLADE FASTENING STRUCTURE

FIELD OF THE INVENTION

The present invention relates to a ceiling fan, and more particularly to a ceiling fan blade fastening structure.

BACKGROUND OF THE INVENTION

A ceiling fan is used for regulating air convection in indoor space, which is mounted on the ceiling of a room or space to generate wind by rotation of the blades. The ceiling fan is large in size. In general, the ceiling fan includes multiple parts, such as a blade base and blades. The parts are packaged together for sale. After purchasing the ceiling fan, the consumer takes out the parts to be assembled together, so as to form a finished ceiling fan.

The blades are not integrally formed with the blade base, and they are connected to the blade base with fasteners, such as screws. It is required to use a tool for assembling the ceiling fan, so as to complete the connection between the parts. In this way, for the manufacturer, it is necessary to provide the correct specification and quantity of parts in the product package, so omissions are likely to occur. For consumers, the assembly is difficult and time-consuming, and the ceiling fan may be incorrectly assembled.

In view of the above-mentioned problems, the industry has developed a fastening structure for blades and a blade base. It is very easy to assemble the ceiling fan by simply inserting the blade into the blade base. However, the ceiling fan uses a motor to drive the blades to rotate, so the blades will be affected by centrifugal force in operation. If the connection between the blades and the blade base is not firm enough, the blades may be thrown out, which is a potential safety concern for the user.

SUMMARY OF THE INVENTION

The primary object of the present invention is to provide a ceiling fan blade fastening structure. A fan blade is installed to a rotating disk of a ceiling fan without using tools. It has the effect of rapid assembly and improved connection stability.

In order to achieve the object, a ceiling fan blade fastening structure provided by the present invention comprises a base and a fan blade.

The base is fixed to a rotor of a motor of a ceiling fan. The base has a bottom wall and a peripheral wall. The peripheral wall has a slot. The bottom wall is provided with a guide rail portion adjacent to the slot. The bottom wall is provided with a bracket and a positioning block behind the guide rail portion.

The fan blade has an end face whose area is greater than that of the slot. A tongue portion extends from the end face. The tongue portion corresponds in area to the slot. The tongue portion is provided with a stop block. When the tongue portion of the fan blade is inserted into the slot, the end face abuts against the peripheral wall, and the tongue portion abuts against the positioning block, so as to position the fan blade. The stop block is against a rear of the bracket, so that the fan blade is unable to be disengaged from the slot.

Preferably, a periphery of the slot has a recess, and the tongue portion of the fan blade is provided with a protrusion corresponding in position and in shape to the recess for the tongue portion to be inserted into the slot in a specific direction.

Preferably, a pin is inserted through the tongue portion of the fan blade and locked to the guide rail portion.

In an embodiment, the tongue portion has two sides in a height direction. Each side of the tongue portion is provided with the stop block. The stop block is spaced apart from the tongue portion and is connected to the corresponding side through a connecting portion. The connecting portion extends along an insertion direction of the tongue portion.

Furthermore, one side of the stop block, facing away from the corresponding side of the tongue portion, has a wedge-shaped face. The stop block further has an upright face behind the wedge-shaped face. When the tongue portion is to be inserted into the slot, the wedge-shaped face is against the bracket and guides the stop block to pass through the bracket. After the stop block passes through the bracket, the upright face is blocked by the bracket so that the fan blade is unable to be disengaged from the slot.

The bracket includes an upright portion integrally connected to the bottom wall and a horizontal portion integrally connected to a top end of the upright portion. When the tongue portion is inserted into the slot, the horizontal portion is above the tongue portion, and the upright face is blocked by the upright portion so that the fan blade is unable to be disengaged from the slot.

In an embodiment, the tongue portion has a top face in a width direction. The stop block is spaced apart from the tongue portion and is connected to the top face through a connecting portion. The connecting portion extends along an insertion direction of the tongue portion.

Furthermore, one side of the stop block, facing the insertion direction of the tongue portion, has a wedge-shaped face. The stop block further has an upright face behind the wedge-shaped face. When the tongue portion is to be inserted into the slot, the wedge-shaped face is against the bracket and guides the stop block to pass through the bracket. After the stop block passes through the bracket, the upright face is blocked by the bracket so that the fan blade is unable to be disengaged from the slot.

The bracket includes an upright portion integrally connected to the bottom wall and a horizontal portion integrally connected to a top end of the upright portion. When the tongue portion is inserted into the slot, the horizontal portion is above the tongue portion, and the upright face is blocked by the upright portion so that the fan blade is unable to be disengaged from the slot.

In an embodiment, the tongue portion has a top face in a width direction. The stop block is spaced apart from the tongue portion and is connected to the top face through a connecting portion. The connecting portion extends in a direction perpendicular to an insertion direction of the tongue portion.

Furthermore, one side of the stop block, facing the insertion direction of the tongue portion, has a wedge-shaped face. The stop block further has an upright face behind the wedge-shaped face. When the tongue portion is to be inserted into the slot, the wedge-shaped face is against the bracket and guides the stop block to pass through the bracket. After the stop block passes through the bracket, the upright face is blocked by the bracket so that the fan blade is unable to be disengaged from the slot.

The bracket includes an upright portion integrally connected to the bottom wall and a horizontal portion integrally connected to a top end of the upright portion. When the tongue portion is inserted into the slot, the horizontal portion is above the tongue portion, and the upright face is blocked by the upright portion so that the fan blade is unable to be disengaged from the slot.

In an embodiment, the bracket includes two brackets disposed on the bottom wall, and the peripheral wall has the slot for installing the fan blade.

In an embodiment, the base is in the form of a disk. The guide rail portion includes a plurality of guide rail portions disposed on the bottom wall. The bracket includes a plurality of brackets disposed on the bottom wall. The slot includes a plurality of slots disposed on the peripheral wall. The fan blade includes a plurality of fan blades to be inserted in the respective slots. The guide rail portions and the brackets correspond in number to the slots.

DETAILED DESCRIPTION OF THE PREFERRED EMBODIMENTS

Embodiments of the present invention will now be described, by way of example only, with reference to the accompanying drawings.

Figure 1:
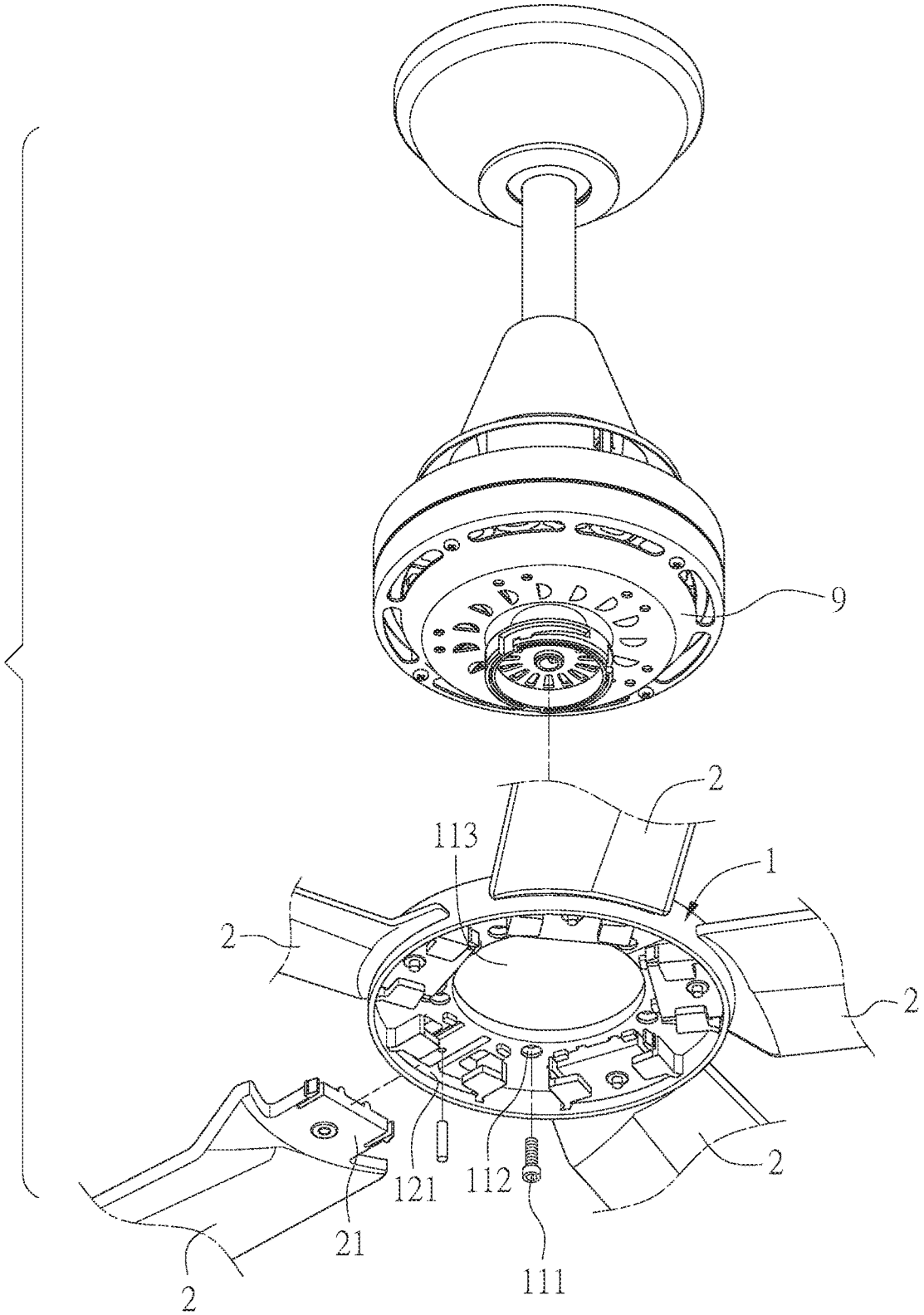
FIG. 1 is a perspective view according to a first embodiment of the present invention.
Figure 2:
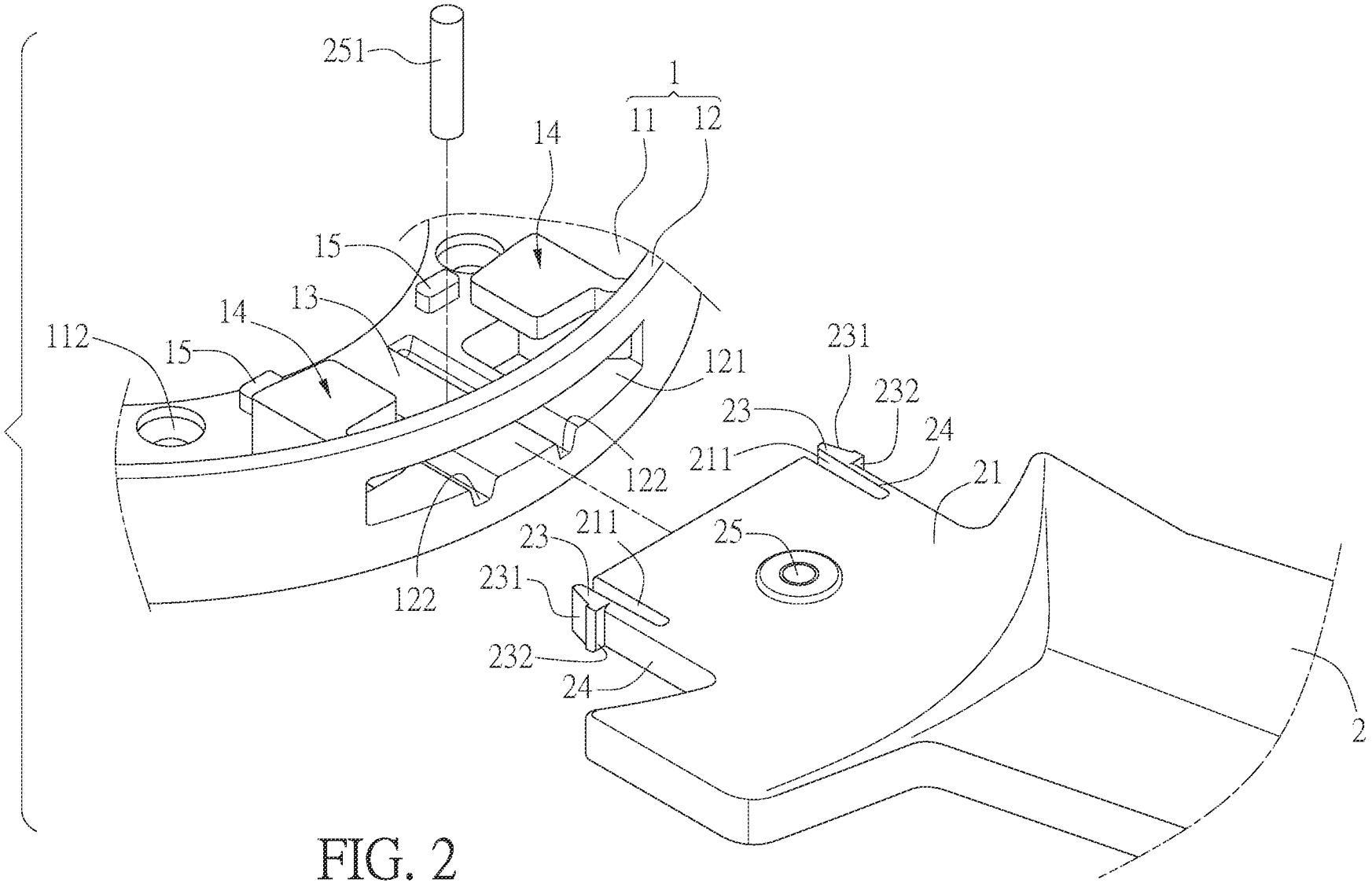
FIG. 2 and FIG. 3 are exploded views according to the first embodiment of the present invention.
Figure 3:
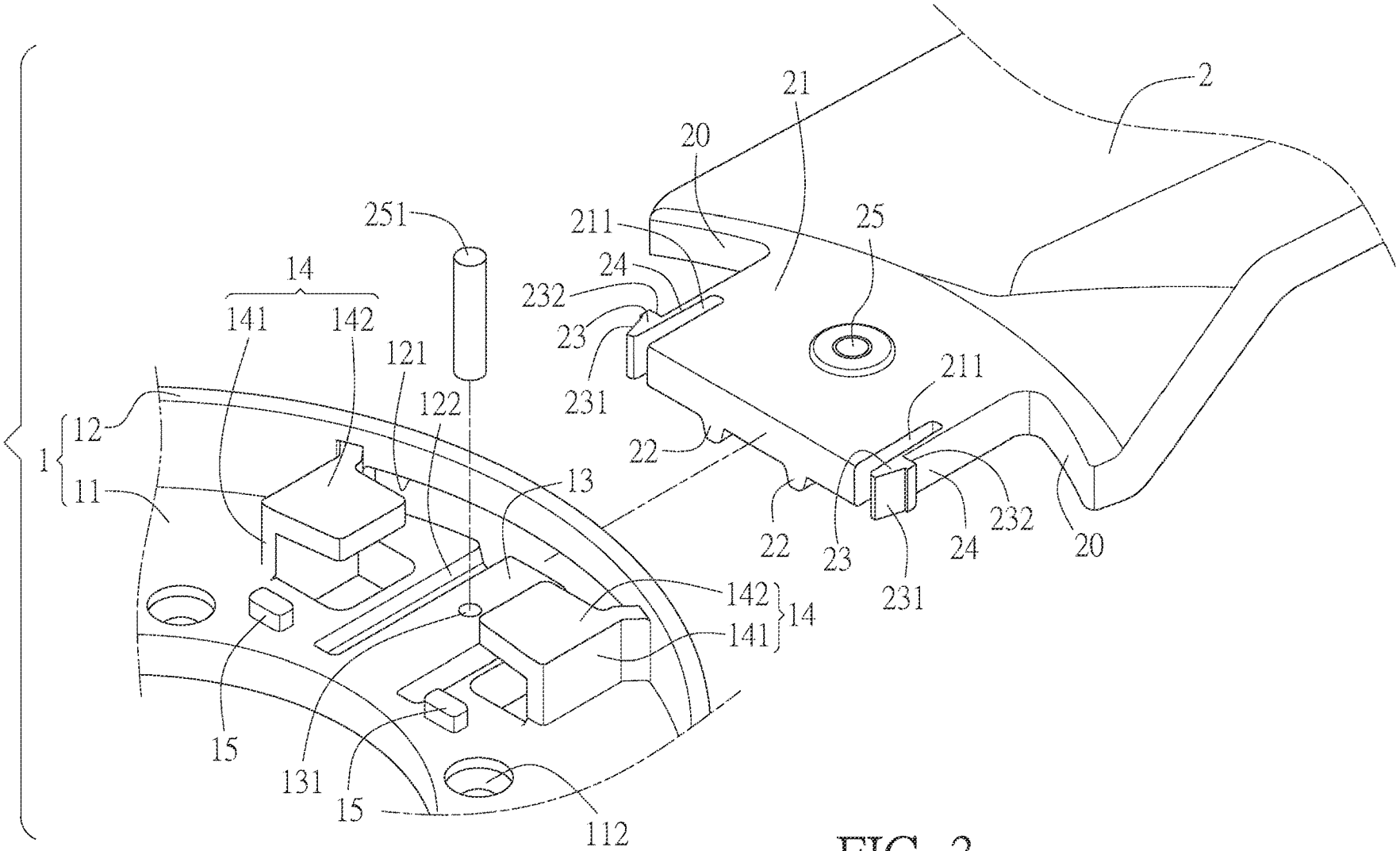

Referring to FIG. 1 through FIG. 3, a ceiling fan blade fastening structure provided by the present invention comprises a base 1 and a plurality of fan blades 2. The base 1 is in the form of a disk, and has a bottom wall 11 and a peripheral wall 12 around the outer periphery of the bottom wall 11. The bottom wall 11 is formed with a plurality of fixing holes 112 for screws 111 to pass therethrough, thereby locking the bottom wall 11 to a motor 9 of the ceiling fan, especially to the rotor of the motor 9. A circular hole 113 is defined in the center of the bottom wall 11 for the motor 9 to pass therethrough.

Figure 4:
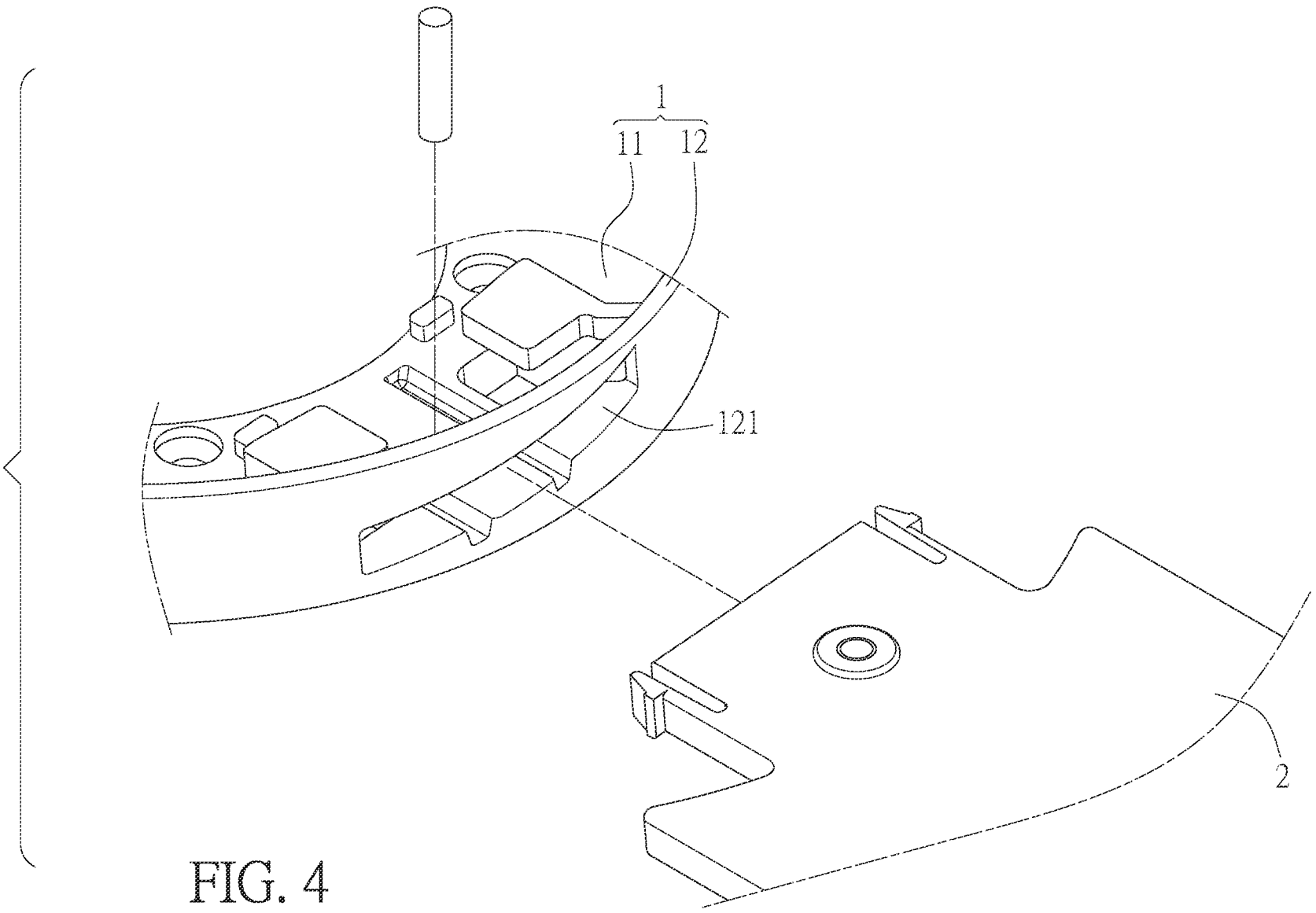
FIG. 4 is an exploded view according to the first embodiment of the present invention, wherein the slot of the base is replaced with another implementation.

The base 1 defines a plurality of areas corresponding in number to the fan blades 2. Each area is coupled with one fan blade 2. In this embodiment, the number of fan blades 2 is five, and the base 1 defines five areas. The peripheral wall 12 has a slot 121 in each area for insertion of the fan blade 2. The slot 121 may be arranged horizontally as shown in FIG. 2, or may be arranged obliquely as shown in FIG. 4. In each area, the bottom wall 11 is provided with a guide rail portion 13 adjacent to the slot 121. Either side of the guide rail portion 13 is provided with a bracket 14. A positioning block 15 is provided behind the guide rail portion 13. The bracket 14 includes an upright portion 141 and a horizontal portion 142 to form an inverted L shape. The upright portion 141 is integrally connected to the bottom wall 11. The horizontal portion 142 is suspended above the bottom wall 11.

Figure 5:
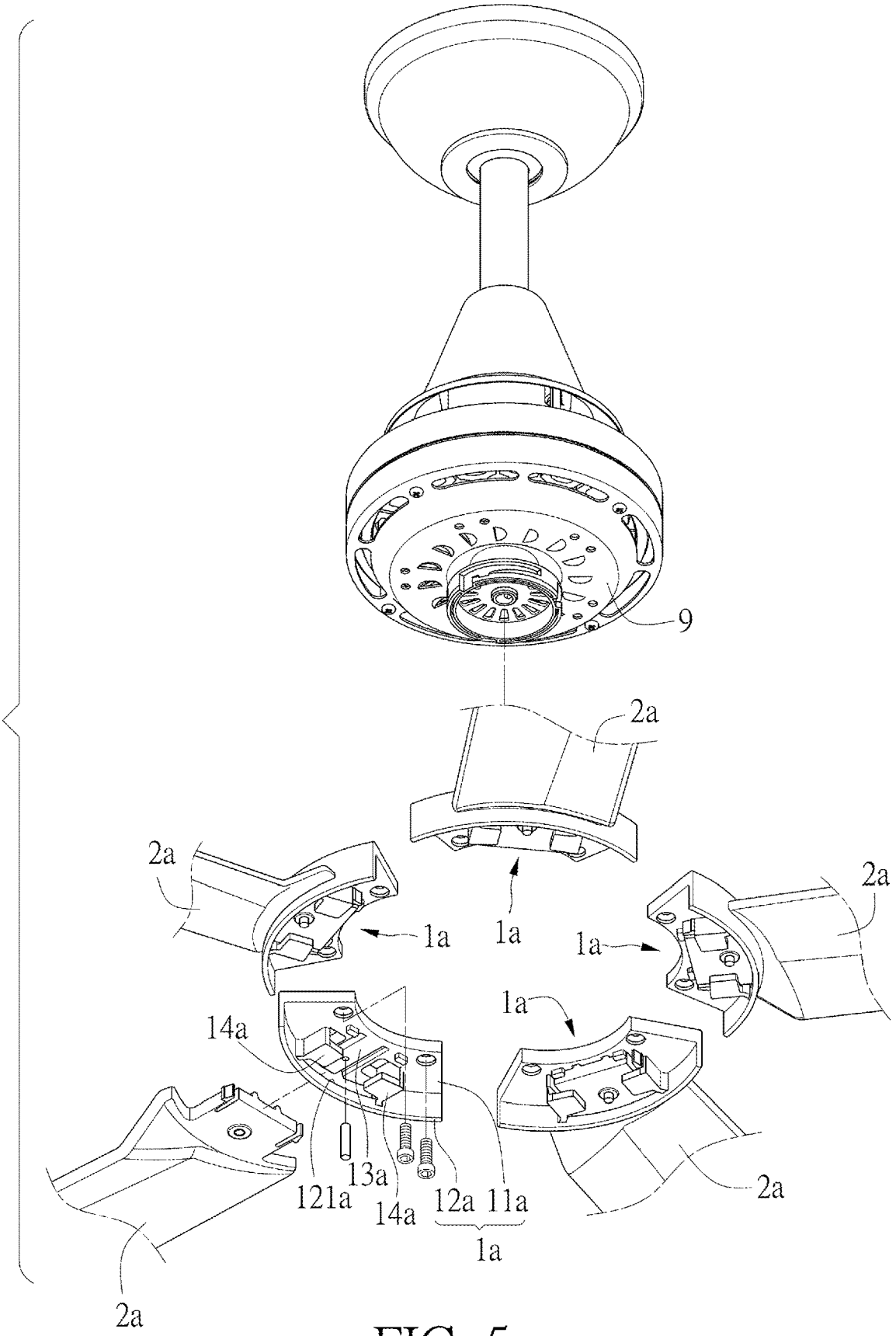
FIG. 5 is an exploded view according to the first embodiment of the present invention, wherein the base is replaced with another implementation.

The base may have another structural implementation as shown in FIG. 5. The base 1*a* is in a fan shape. The bottom wall 11*a* is provided with a guide rail portion 13*a* and two brackets 14*a*. The peripheral wall 12*a* has a slot 121*a* for installing a fan bladed 2*a*. The base 1*a* corresponds in number to the fan bladed 2*a*. The base 1*a* is fixed to the motor 9 of the ceiling fan.

As shown in FIG. 2 and FIG. 3, one end of the fan blade 2 defines an end face 20 whose area is greater than that of the slot 121. A tongue portion 21 extends from the end face 20. The tongue portion 21 corresponds in area to the slot 121. The tongue portion 21 is inserted from the slot 121 to move along the guide rail portion 13 to be positioned below the horizontal portion 142. The end face 20 of the fan blade 2 abuts against the peripheral wall 12, and the tongue portion 21 abuts against the positioning block 15, thereby positioning the fan blade 2. One side of the tongue portion 21 is provided with two protrusions 22 extending along an insertion direction of the tongue portion 21. The periphery of the slot 121 has two recesses 122 corresponding to the protrusions 22. The tongue portion 21 can only be inserted into the slot 121 in a direction that the protrusions 22 are aligned with the recesses 122, thereby providing a fool-proof effect to avoid wrong insertion.

Figure 6:
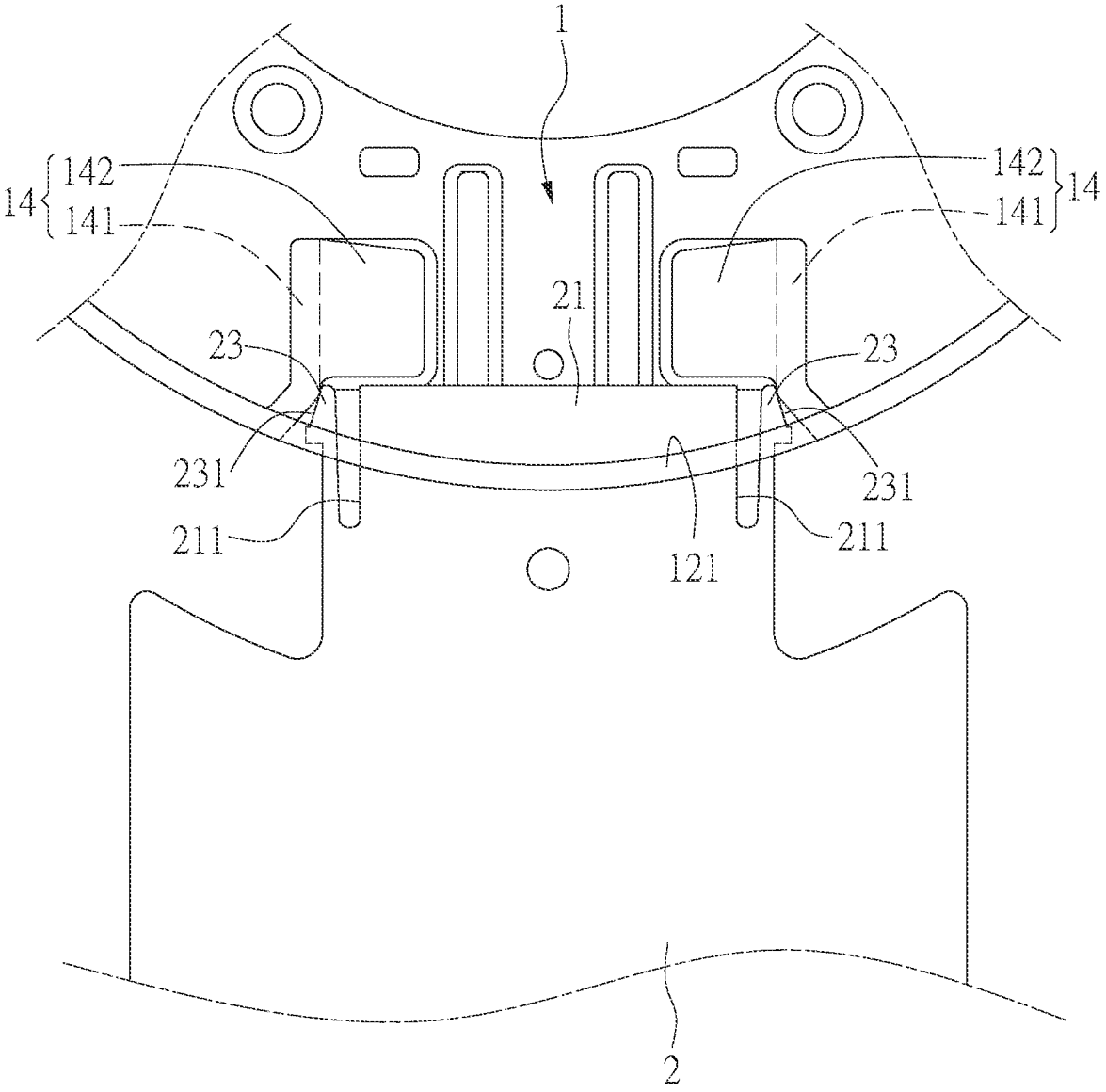
FIG. 6, FIG. 7 and FIG. 8 are schematic views illustrating the assembly operations of the first embodiment of the present invention.
Figure 7:
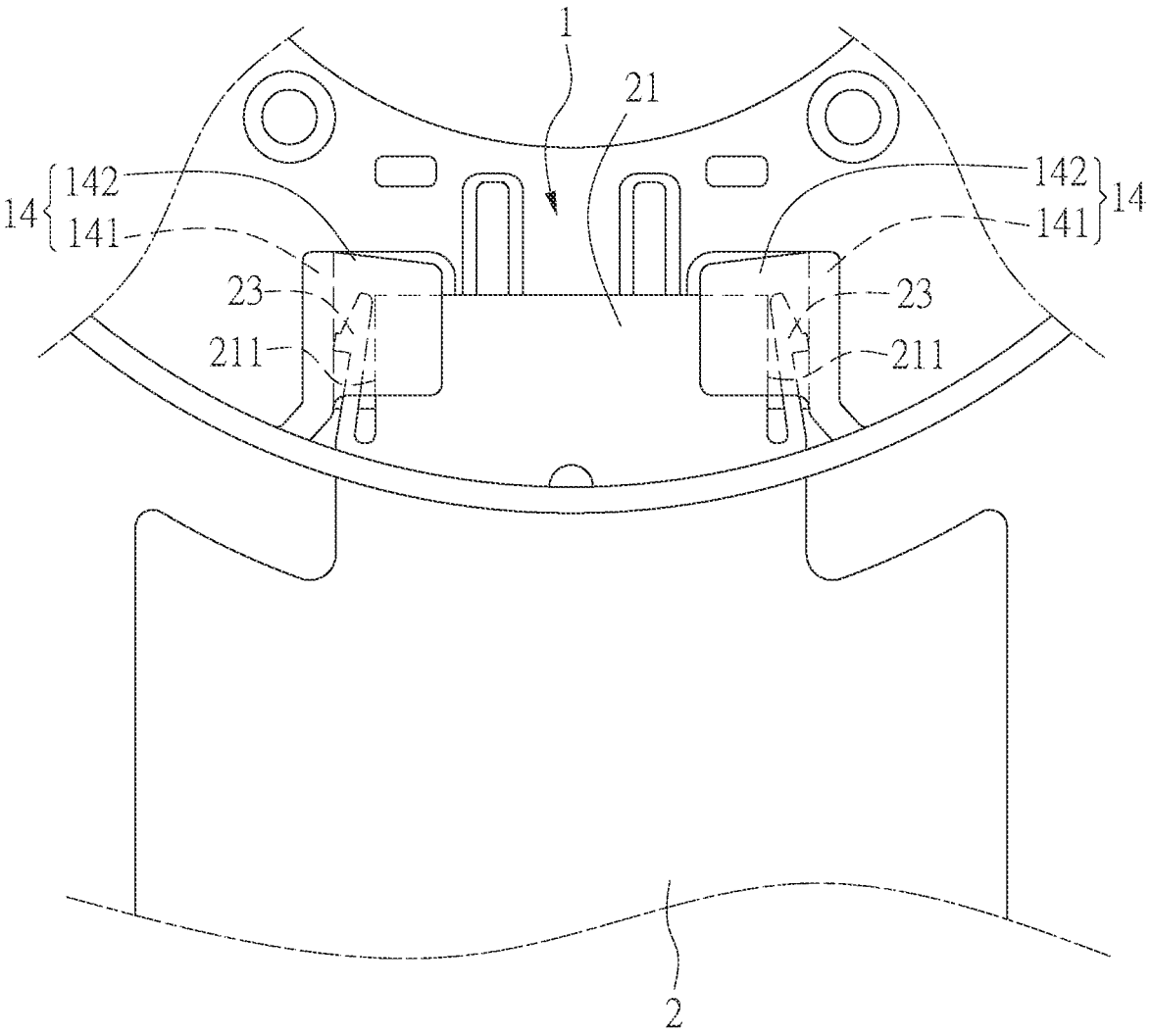
Figure 8:
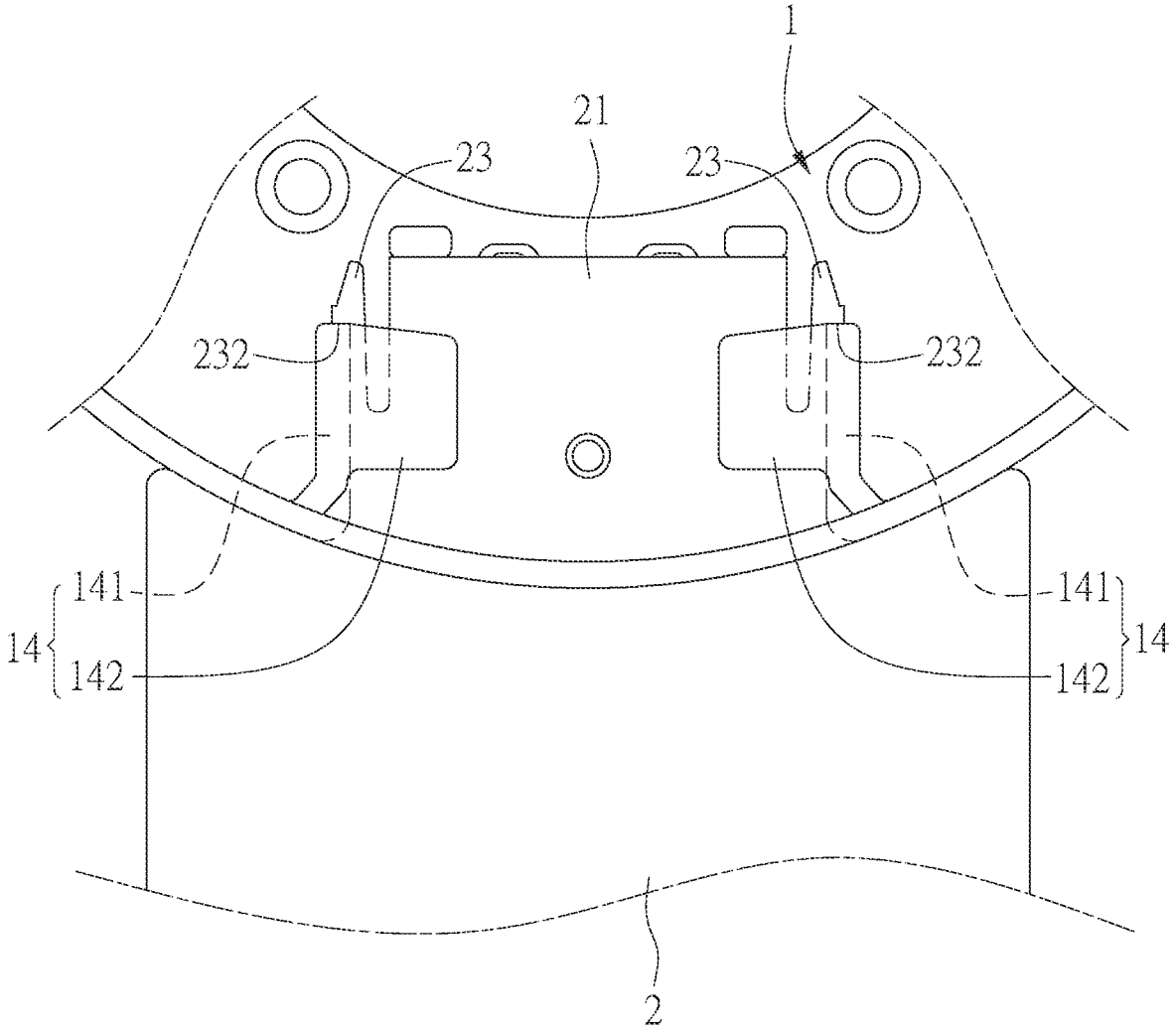

The tongue portion 21 has two sides 211 in the height direction. Each side 211 is provided with a stop block 23. The stop block 23 is spaced apart from the tongue portion 21 and is connected to the corresponding side 211 through a connecting portion 24. The connecting portion 24 extends along the insertion direction of the tongue portion 21. One side of the stop block 23, facing away from the corresponding side 211, has a wedge-shaped face 231. The wedge-shaped face 231 faces the insertion direction of the tongue portion 21. The stop block 23 further has an upright face 232 behind the wedge-shaped face 231. When the tongue portion 21 of the fan blade 2 is inserted into the slot 121 of the base 1, as shown in FIGS. 6-8, the wedge-shaped face 231 of the stop block 23 is against the upright portion 141 of the bracket 14. In the insertion process, the wedge-shaped face 231 guides the stop block 23 to approach the corresponding side 211, so as to pass through the upright portion 141. After the stop block 23 passes through the upright portion 141, the stop block 23 returns to its original state, and then the upright face 232 abuts against the upright portion 141, thereby providing a blocking effect, so that the fan blade 2 is unable to be disengaged from the slot 121.

Furthermore, the guide rail portion 13 has a positioning hole 131. The tongue portion 21 of the fan blade 2 has a through hole 25 aligned with the positioning hole 131. A pin 251 passes through the through hole 25 and is locked in the positioning hole 131 to ensure that the fan blade 2 is secured to the base 1 to prevent it from flying out due to centrifugal force during rotation.

Figure 9:
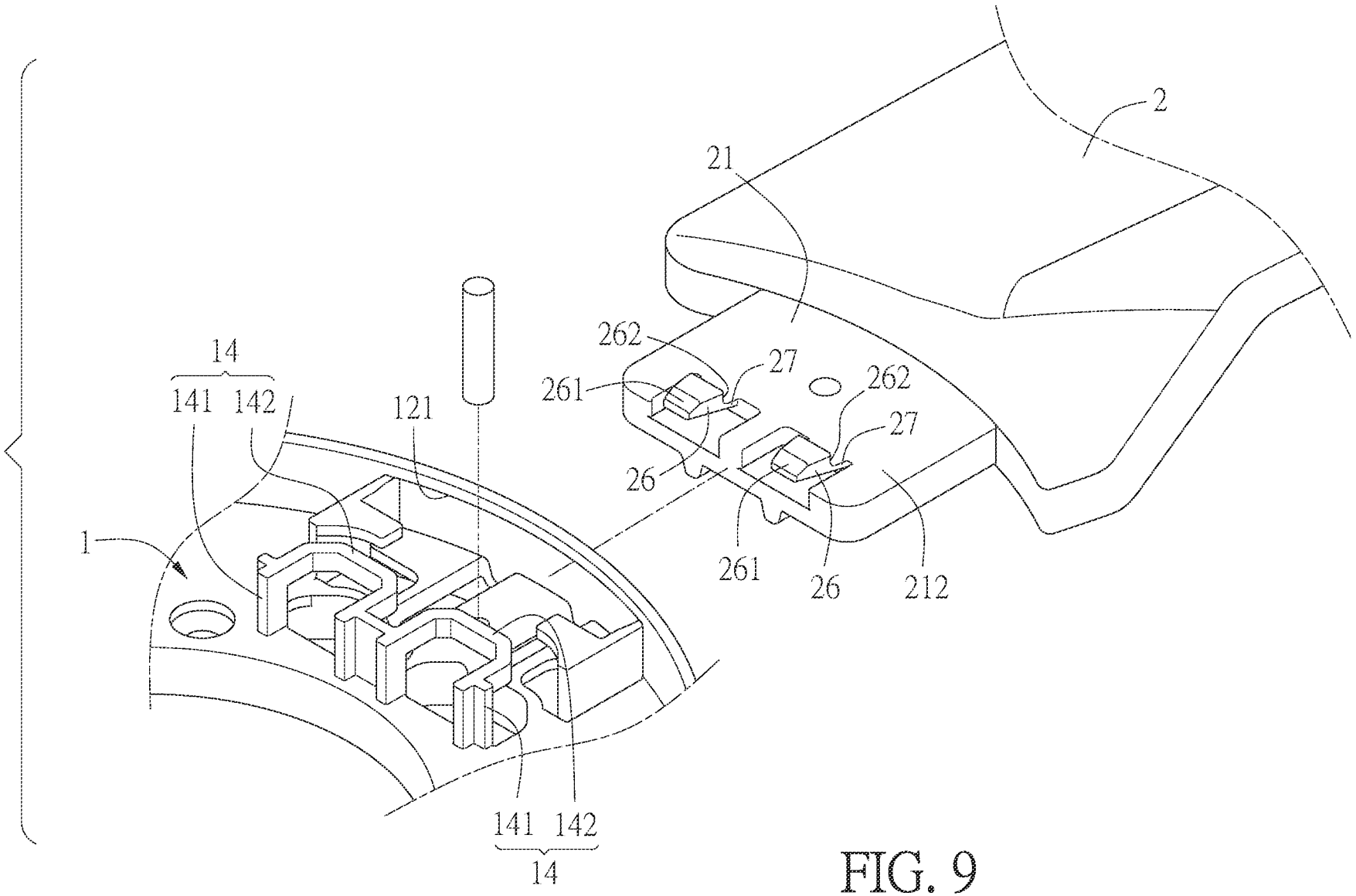
FIG. 9 and FIG. 10 are exploded views according to a second embodiment of the present invention.
Figure 10:
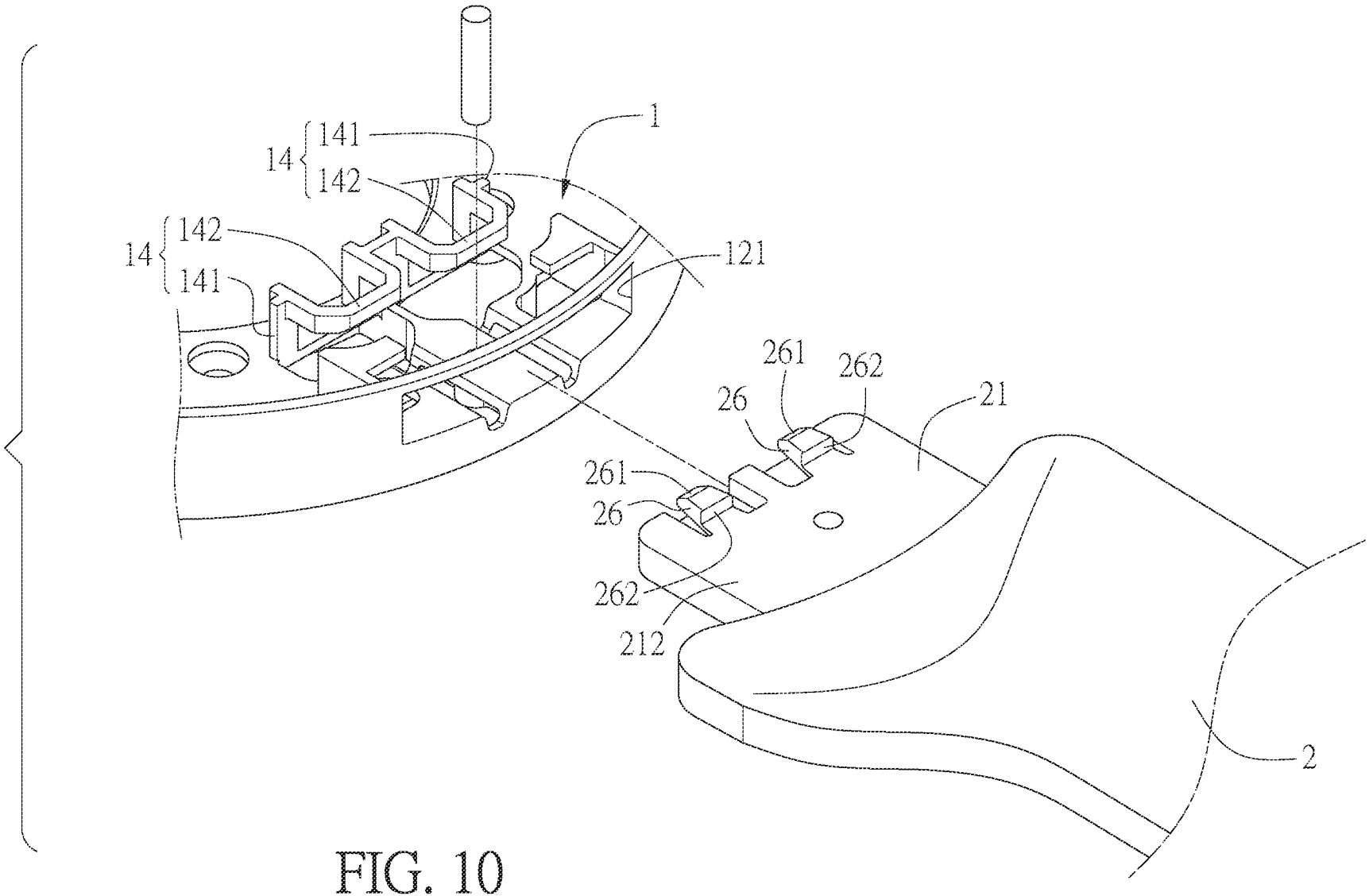
Figure 11:
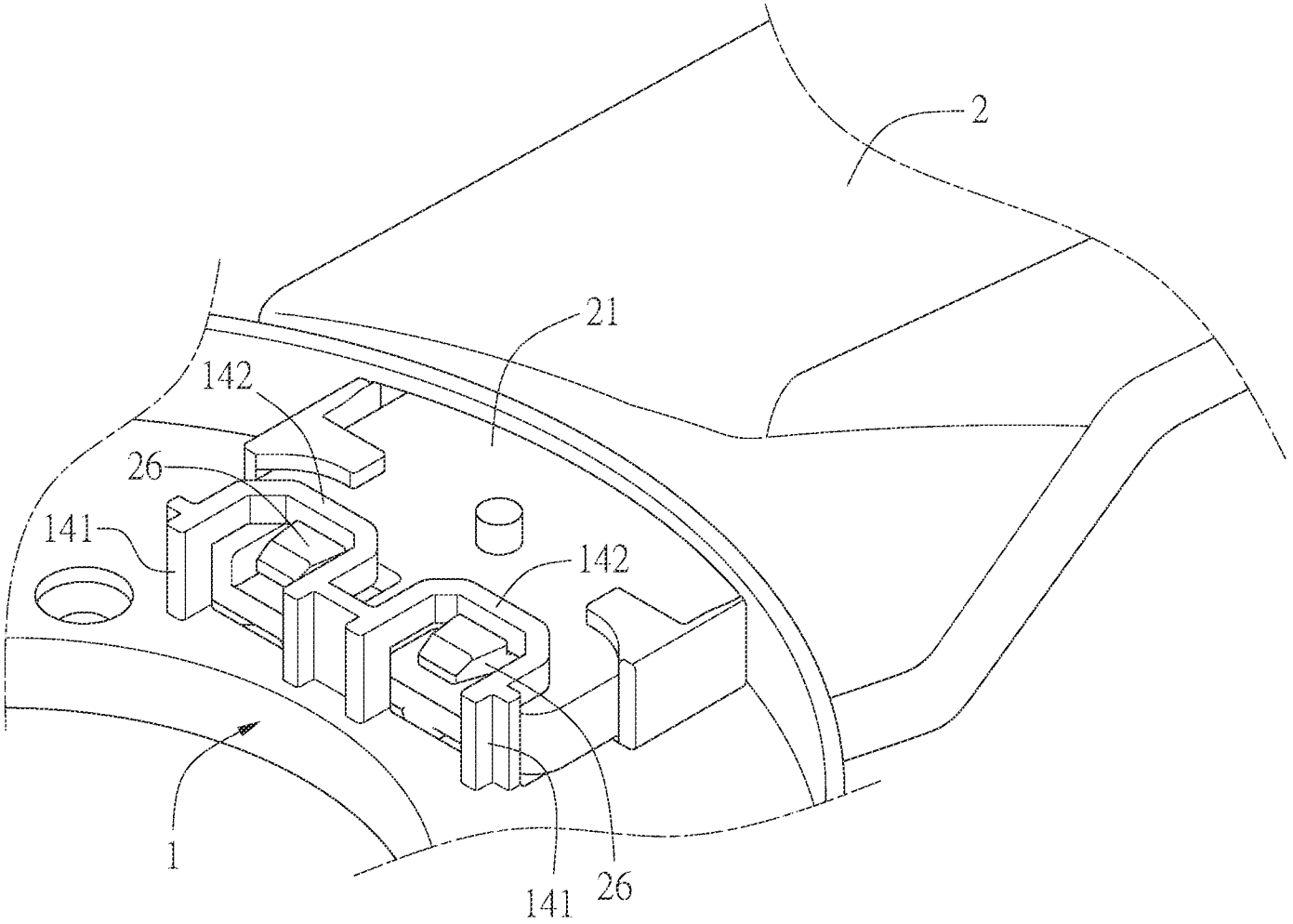
FIG. 11 is a partial perspective view according to the second embodiment of the present invention.

FIGS. 9 to 11 illustrate a second embodiment provided by the present invention. The structure of the second embodiment is based on the structure of the first embodiment, and the difference lies in the structure and interaction of the stop block and the bracket. In this embodiment, the tongue portion 21 has a top face 212 in the width direction. The stop block 26 is connected to the top face 212 through a connecting portion 27 in a direction parallel to the insertion direction. One side of the stop block 26, facing away from the top face 212, has a wedge-shaped face 261. The wedge-shaped face 261 faces the insertion direction of the tongue portion 21. The stop block 26 further has an upright face 262 behind the wedge-shaped face 261. When the fan blade 2 is to be assembled, the tongue portion 21 is inserted into the slot 121. The wedge-shaped face 261 of the stop block 26 is against the horizontal portion 142 of the bracket 14. In the insertion process, the wedge-shaped face 261 guides the stop block 26 to approach the top face 212, so as to pass through the horizontal portion 142. After the stop block 26 passes through the horizontal portion 142, the stop block 23 returns to its original state, and then the upright face 262 abuts against the horizontal portion 142, thereby providing a blocking effect, so that the fan blade 2 is unable to be disengaged from the slot 121.

Figure 12:
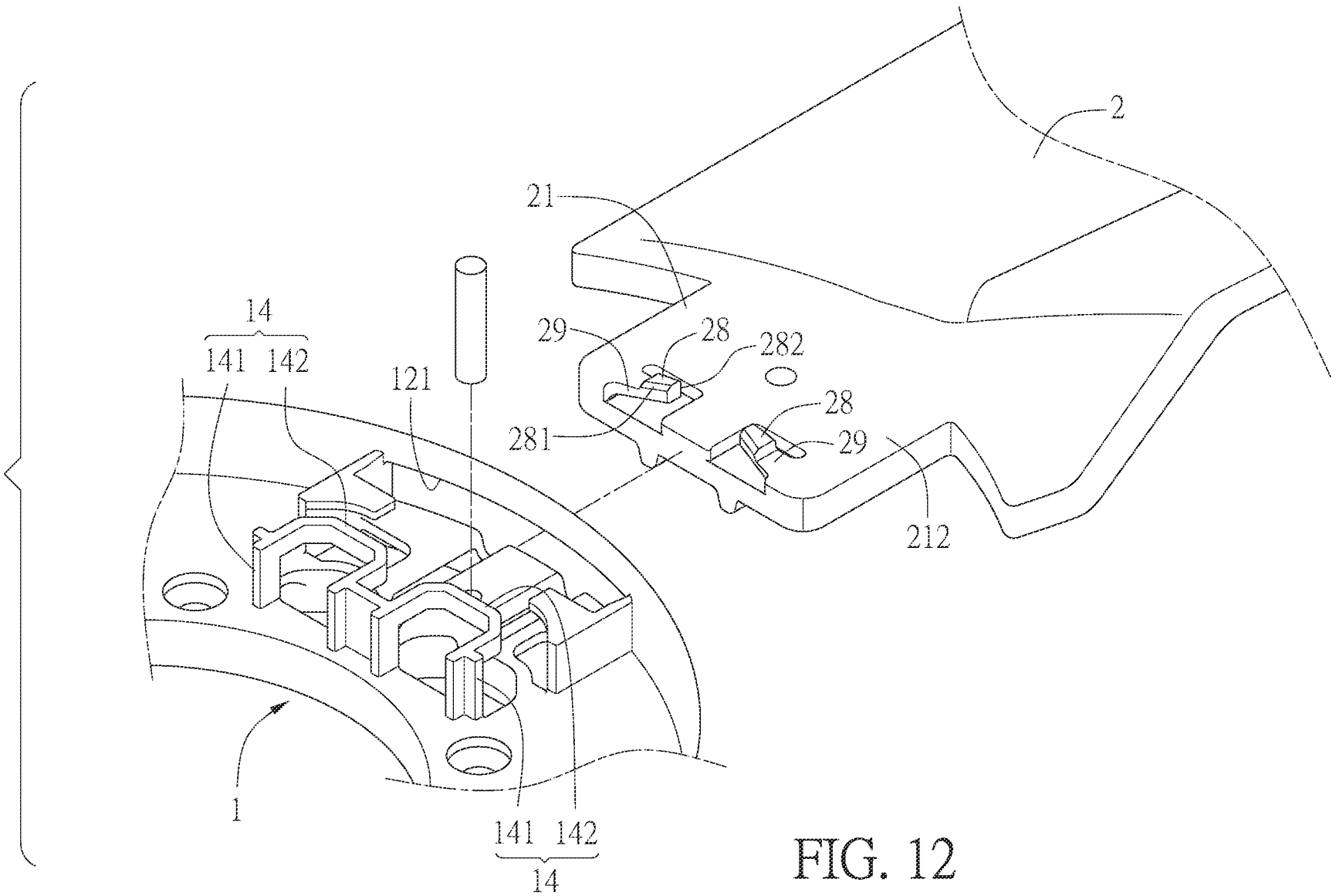
FIG. 12 and FIG. 13 are exploded views according to a third embodiment of the present invention.
Figure 13:
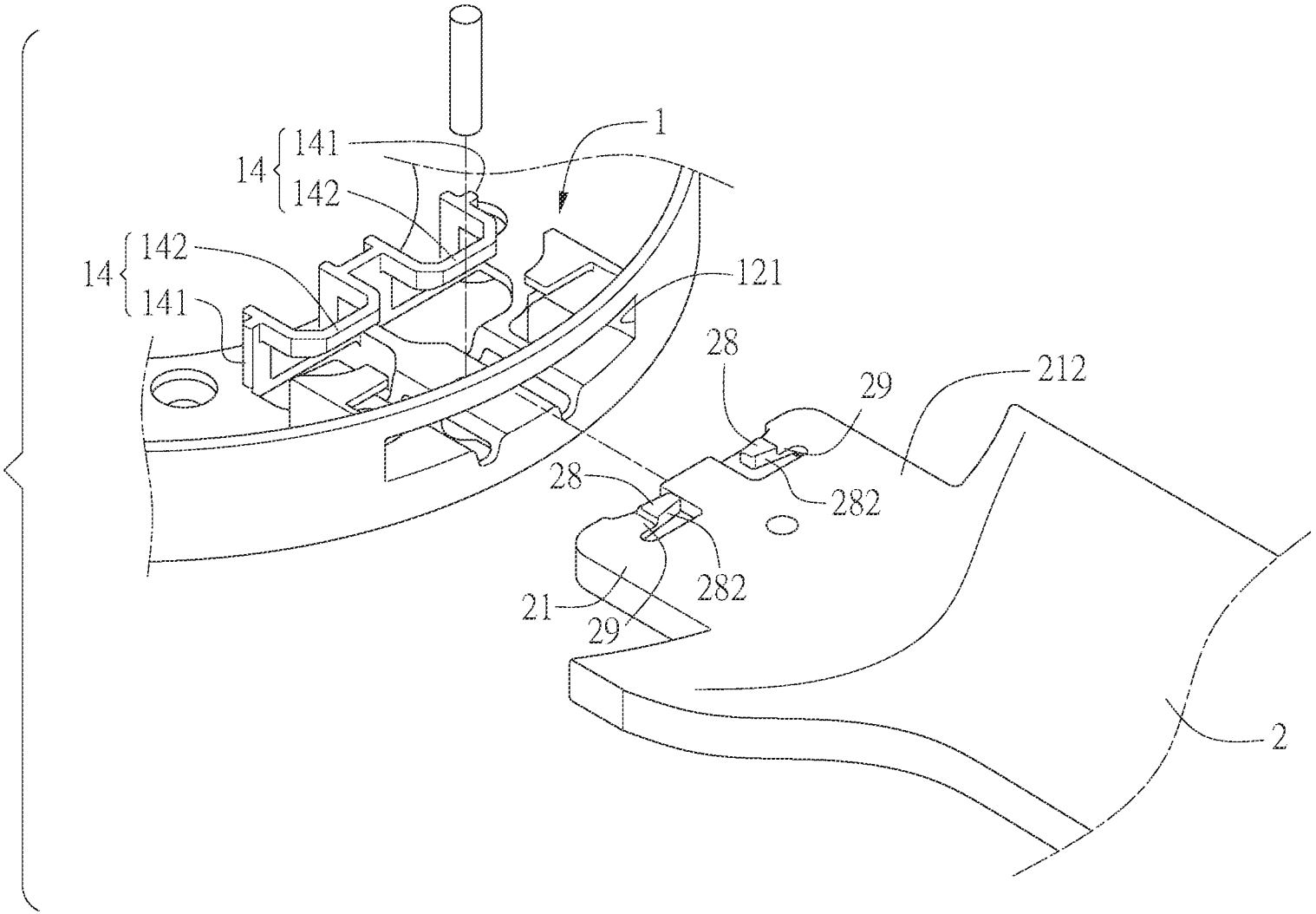
Figure 14:
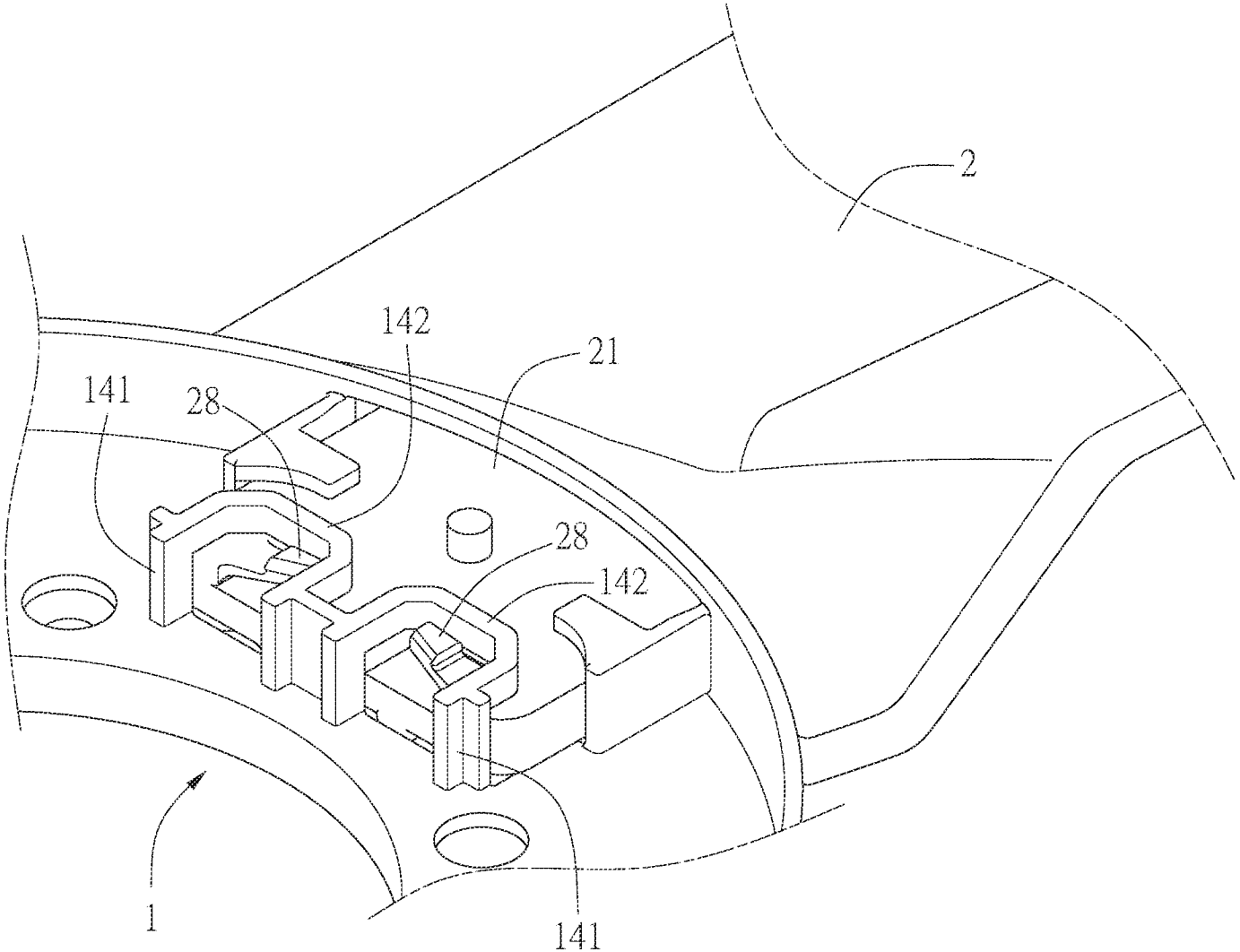
FIG. 14 is a partial perspective view according to the third embodiment of the present invention.

FIGS. 12 to 14 illustrate a third embodiment provided by the present invention. The structure of the third embodiment is based on the structure of the first embodiment, and the difference lies in the structure and interaction of the stop block and the bracket. In this embodiment, the tongue portion 21 has a top face 212 in the width direction. The stop block 28 is connected to the top face 212 through a connecting portion 29 in a direction perpendicular to the insertion direction. One side of the stop block 28, facing away from the top face 212, has a wedge-shaped face 281. The wedge-shaped face 281 faces the insertion direction of the tongue portion 21. The stop block 28 further has an upright face 282 behind the wedge-shaped face 281. When the fan blade 2 is to be assembled, the tongue portion 21 is inserted into the slot 121. The wedge-shaped face 281 of the stop block 28 is against the horizontal portion 142 of the bracket 14. In the insertion process, the wedge-shaped face 281 guides the stop block 28 to approach the top face 212, so as to pass through the horizontal portion 142. After the stop block 28 passes through the horizontal portion 142, the stop block 28 returns to its original state, and then the upright face 282 abuts against the horizontal portion 142, thereby providing a blocking effect, so that the fan blade 2 is unable to be disengaged from the slot 121.

What is claimed is:

1. A ceiling fan blade fastening structure, comprising:

a base, fixed to a rotor of a motor of a ceiling fan, the base having a bottom wall and a peripheral wall, the peripheral wall having a slot, the bottom wall being provided with a guide rail portion adjacent to the slot, the bottom wall being provided with a bracket and a positioning block behind the guide rail portion, the positioning block is a rectangle block that protruded from the bottom wall;

a fan blade, having an end face whose area is greater than that of the slot, a tongue portion extending from the end face, the tongue portion corresponding in area to the slot, the tongue portion being provided with two stop blocks, wherein when the tongue portion of the fan blade is inserted into the slot, the end face abuts against the peripheral wall, and the tongue portion abuts against the positioning block, so as to position the fan blade; wherein the two stop blocks are against a rear of the bracket, so that the fan blade is at least removably fixed, wherein the tongue portion has two sides in a height direction, each side of the two sides of the tongue portion is provided with each stop block of the two stop blocks, each stop block is spaced apart from the tongue portion and is connected to the each side through a connecting portion, the connecting portion extends along an insertion direction of the tongue portion, and a gap is formed between the side and the connecting portion, wherein one side of each stop block, facing away from each side of the tongue portion, has a wedge-shaped face, each stop block further has an upright face behind the wedge-shaped face, when the tongue portion is to be inserted into the slot, the wedge-shaped face is against the bracket and guides each stop block to pass through the bracket, after each stop block passes through the bracket, the upright face is blocked by the bracket so that the fan blade is at least removably fixed, and each stop block is shaped as a triangle so as to form the wedge-shaped face and the upright face, and wherein the bracket includes an upright portion monolithically connected to the bottom wall and a horizontal portion monolithically connected to a top end of the upright portion, when the tongue portion is inserted into the slot, the horizontal portion is above the tongue portion, the upright face is blocked by the upright portion so that the fan blade is at least removably fixed, and a height of the upright portion is less than a height of the peripheral wall.

2. The ceiling fan blade fastening structure as claimed in claim 1, wherein a periphery of the slot has a recess, and the tongue portion of the fan blade is provided with a protrusion corresponding in position and in shape to the recess for the tongue portion to be inserted into the slot in a specific direction.

3. The ceiling fan blade fastening structure as claimed in claim 1, wherein a pin is inserted through the tongue portion of the fan blade and locked to the guide rail portion.

4. The ceiling fan blade fastening structure as claimed in claim 1, wherein the tongue portion has a top face in a width direction, the stop block is spaced apart from the tongue portion and is connected to the top face through a connecting portion, and the connecting portion extends along an insertion direction of the tongue portion.

5. The ceiling fan blade fastening structure as claimed in claim 4, wherein one side of the stop block, facing the insertion direction of the tongue portion, has a wedge-shaped face, the stop block further has an upright face behind the wedge-shaped face, when the tongue portion is to be inserted into the slot, the wedge-shaped face is against the bracket and guides the stop block to pass through the bracket, after the stop block passes through the bracket, the upright face is blocked by the bracket so that the fan blade is unable to be disengaged from the slot.

6. The ceiling fan blade fastening structure as claimed in claim 5, wherein the bracket includes an upright portion monolithically connected to the bottom wall and a horizontal portion monolithically connected to a top end of the upright portion, when the tongue portion is inserted into the slot, the horizontal portion is above the tongue portion, and the upright face is blocked by the upright portion so that the fan blade is unable to be disengaged from the slot.

7. The ceiling fan blade fastening structure as claimed in claim 1, wherein the tongue portion has a top face in a width direction, the stop block is spaced apart from the tongue portion and is connected to the top face through a connecting portion, and the connecting portion extends in a direction perpendicular to an insertion direction of the tongue portion.

8. The ceiling fan blade fastening structure as claimed in claim 7, wherein one side of the stop block, facing the insertion direction of the tongue portion, has a wedge-shaped face, the stop block further has an upright face behind the wedge-shaped face, when the tongue portion is to be inserted into the slot, the wedge-shaped face is against the bracket and guides the stop block to pass through the bracket, after the stop block passes through the bracket, the upright face is blocked by the bracket so that the fan blade is unable to be disengaged from the slot.

9. The ceiling fan blade fastening structure as claimed in claim 8, wherein the bracket includes an upright portion monolithically connected to the bottom wall and a horizontal portion monolithically connected to a top end of the upright portion, when the tongue portion is inserted into the slot, the horizontal portion is above the tongue portion, and the upright face is blocked by the upright portion so that the fan blade is unable to be disengaged from the slot.

10. The ceiling fan blade fastening structure as claimed in claim 1, wherein the bracket includes two brackets disposed on the bottom wall, and the peripheral wall has the slot for installing the fan blade.

11. The ceiling fan blade fastening structure as claimed in claim 1, wherein the base is in the form of a disk, the guide rail portion includes a plurality of guide rail portions disposed on the bottom wall, the bracket includes a plurality of brackets disposed on the bottom wall, the slot includes a plurality of slots disposed on the peripheral wall, the fan blade includes a plurality of fan blades to be inserted in the plurality of slots; the plurality of guide rail portions and the plurality of brackets correspond in number to the plurality of slots.

* * * * *